US012807346B2

(12) United States Patent
De Silva et al.

(10) Patent No.: US 12,807,346 B2
(45) Date of Patent: Nov. 24, 2026

(54) FILLING STATION

(71) Applicant: Machan Investments LLC, Gardena, CA (US)

(72) Inventors: Anuradha Andy De Silva, Ranchos Palos Verdes, CA (US); Shehan James, Aliso Viejo, CA (US); Dinesh Weerasekera, Fullerton, CA (US); Maoyang Weng, Guangdong (CH)

(73) Assignee: Hotel Emporium Inc., Gardena, CA (US)

( * ) Notice: Subject to any disclaimer, the term of this patent is extended or adjusted under 35 U.S.C. 154(b) by 0 days.

(21) Appl. No.: 18/771,287

(22) Filed: Jul. 12, 2024

(65) Prior Publication Data

US 2026/0015112 A1 Jan. 15, 2026

(51) Int. Cl.
*B65B 3/28* (2006.01)
*B65B 3/04* (2006.01)

(52) U.S. Cl.
CPC . *B65B 3/28* (2013.01); *B65B 3/04* (2013.01)

(58) Field of Classification Search
CPC ..... B67D 1/06; B65B 3/28
See application file for complete search history.

(56) References Cited

U.S. PATENT DOCUMENTS 2,162,625 A 6/1939 Alexander
6,443,334 B1 * 9/2002 John ..... B67D 1/0004 222/146.6
7,131,468 B2 * 11/2006 Schuman ..... B67D 7/741 141/2
11,952,254 B1 * 4/2024 Grimes ..... B67D 7/02
2002/0030102 A1 * 3/2002 Brown ..... G07F 7/06 235/435
2003/0051767 A1 * 3/2003 Coccaro ..... B67D 7/348 141/351

FOREIGN PATENT DOCUMENTS

| | | |
|---|---|---|
| DE | 4442718 | 6/1996 |
| EP | 2199995 | 6/2010 |
| WO | 2011/153575 | 12/2011 |

* cited by examiner

*Primary Examiner* — Timothy P. Kelly
(74) *Attorney, Agent, or Firm* — Eric Karich; Karich & Associates

(57) ABSTRACT

A filling station for transferring a liquid from a large bulk container to a smaller container has a station housing with a top pedestal supported above a bottom pedestal by a support body, the top pedestal being configurated to support the smaller container, and the bottom pedestal being configurated to support the large bulk container. A scale is operably mounted on the top pedestal, the scale having a load cell for measuring the weight of the smaller container. A fluid flow conduit system extends from a fluid intake tube positioned above the bottom pedestal, to a fluid outlet port positioned above the top pedestal. A pump is mounted in or on the station housing for pumping the liquid from the fluid intake tube to the fluid outlet port, for transferring the fluid from the large bulk container to the smaller container via the fluid flow conduit system.

3 Claims, 5 Drawing Sheets

FILLING STATION

BACKGROUND OF THE INVENTION

Field of the Invention

This invention relates generally to filling stations, and more particularly to an assembly for automatically transferring a liquid from a supply container to a smaller container.

Description of Related Art

The prior art teaches various forms of devices for filling smaller containers with a liquid, particularly in the hospitality field, where smaller containers of toiletries such as shampoo and soap must be routinely refilled.

Grimes, U.S. Pat. No. 11,952,254, for example, teaches a fluid dispensing assembly for refilling empty reuseable jars from a source container positioned on separate scales within a housing. Each reuseable jar provides an RFID tag identity read by its respective scale RFID reader to provide selective operational parameters. Separate housing tower assemblies are fluidly connected to the central pumping assembly between the tower assemblies to draw product from the source container to the fill jar. Microprocessor-based control is electrically coupled to the pumping assembly, the scales, and RFID readers to turn fluid flow on and off. The control actuates the pumping assembly to dispense a precise amount of the fluid based upon the RFID identity and real time scale readings and activates tower assembly manifold movement to allow for replacement of empty source and full fill jars.

SUMMARY OF THE INVENTION

The present invention teaches certain benefits in construction and use which give rise to the objectives described below.

The present invention provides a filling station for transferring a liquid from a large bulk container to a smaller container. The filling station comprises a station housing having a top pedestal supported above a bottom pedestal by a support body, the top pedestal being configurated to support the smaller container, and the bottom pedestal being configurated to support the large bulk container. A scale is operably mounted on the top pedestal, the scale having a load cell for measuring the weight of the smaller container. A fluid flow conduit system extends from a fluid intake tube positioned above the bottom pedestal, to a fluid outlet port positioned above the top pedestal. A pump is mounted in or on the station housing for pumping the liquid from the fluid intake tube to the fluid outlet port, for transferring the fluid from the large bulk container to the smaller container via the fluid flow conduit system.

A primary objective of the present invention is to provide a filling station having advantages not taught by the prior art.

Another objective is to provide a filling station adapted to quickly and simply transfer fluid from a large bulk container to a smaller container.

A further objective is to provide a filling station that utilizes RFID tags to ensure the correct type of fluid is transferred during filling.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention.

DETAILED DESCRIPTION OF THE INVENTION

The above-described drawing figures illustrate the invention, a filling station for transferring liquids from large bulk containers to smaller containers. Typical uses are for filling station are for filling small dispenser containers with toiletry products (e.g., soap, shampoo, conditioner, lotion, etc.), as well as any other forms of liquid products.

For purposes of this application, the term "container" is broadly defined to include any form of bottle, flask, bowl, receptacle, canister, cartridge, or other structure known in the art for containing and dispensing a liquid. The term "liquid product" is also broadly defined to include any form of liquid product, such as soap, lotion, shampoo, conditioner, or any other similar product known in the art, including but not limited to cosmetics, cleaning formulations, chemicals, and any other forms of liquids which might need to be dispensed in a manner consistent with this disclosure, or as otherwise known in the art.

Furthermore, the term "large" (as in the "large bulk container") means a container that is larger than the smaller container, and includes any form of bulk storage container known in the art. The term "smaller" is defined to mean smaller than the large container, typically containers of toiletries that are used by the end user, and which are periodically refilled from the large bulk container.

Figure 1:
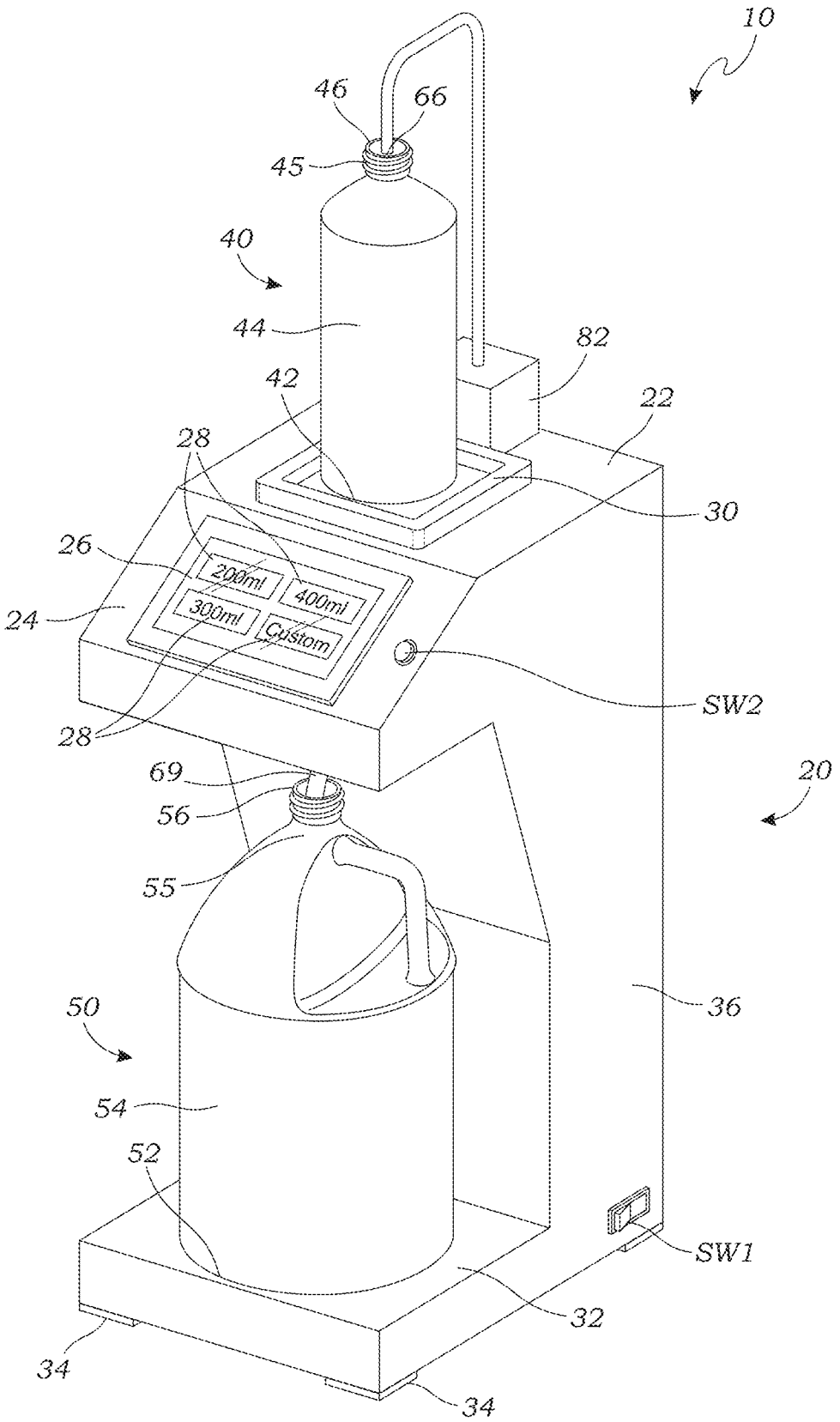
FIG. 1 is a perspective view of a filling station according to one embodiment of the present invention.
Figure 2:
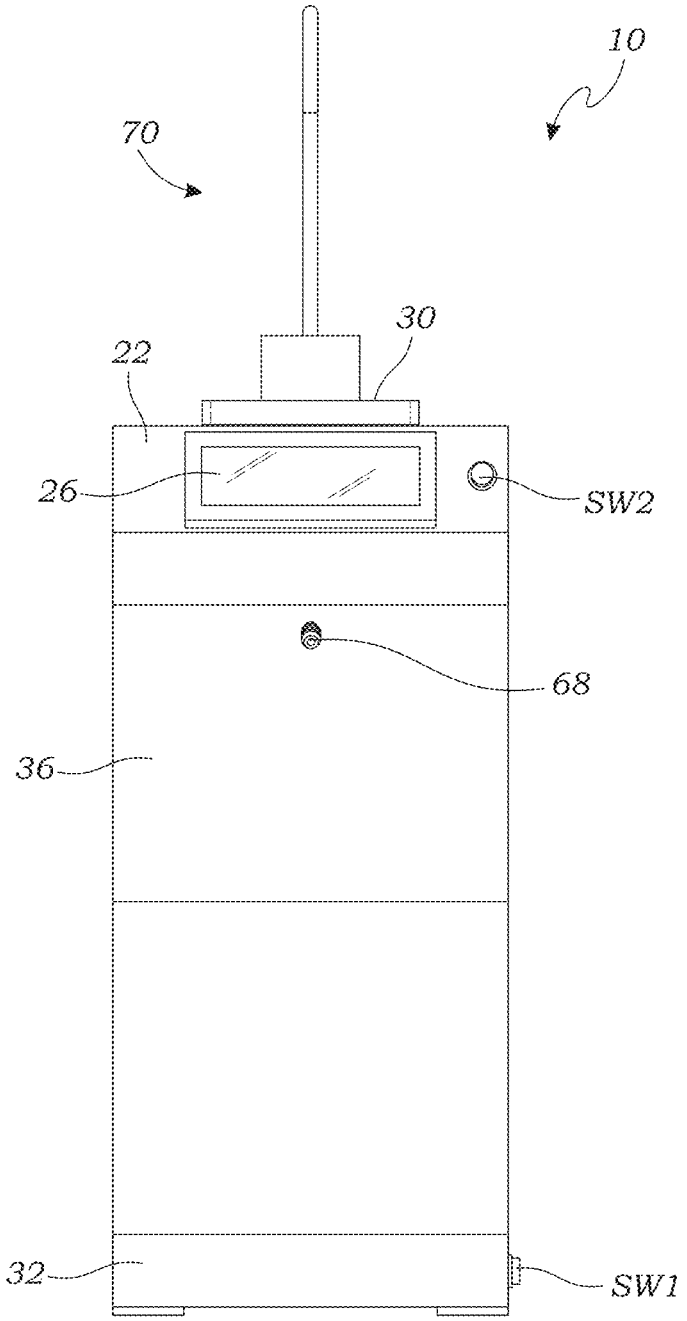
FIG. 2 is a front elevation view thereof.
Figure 3:
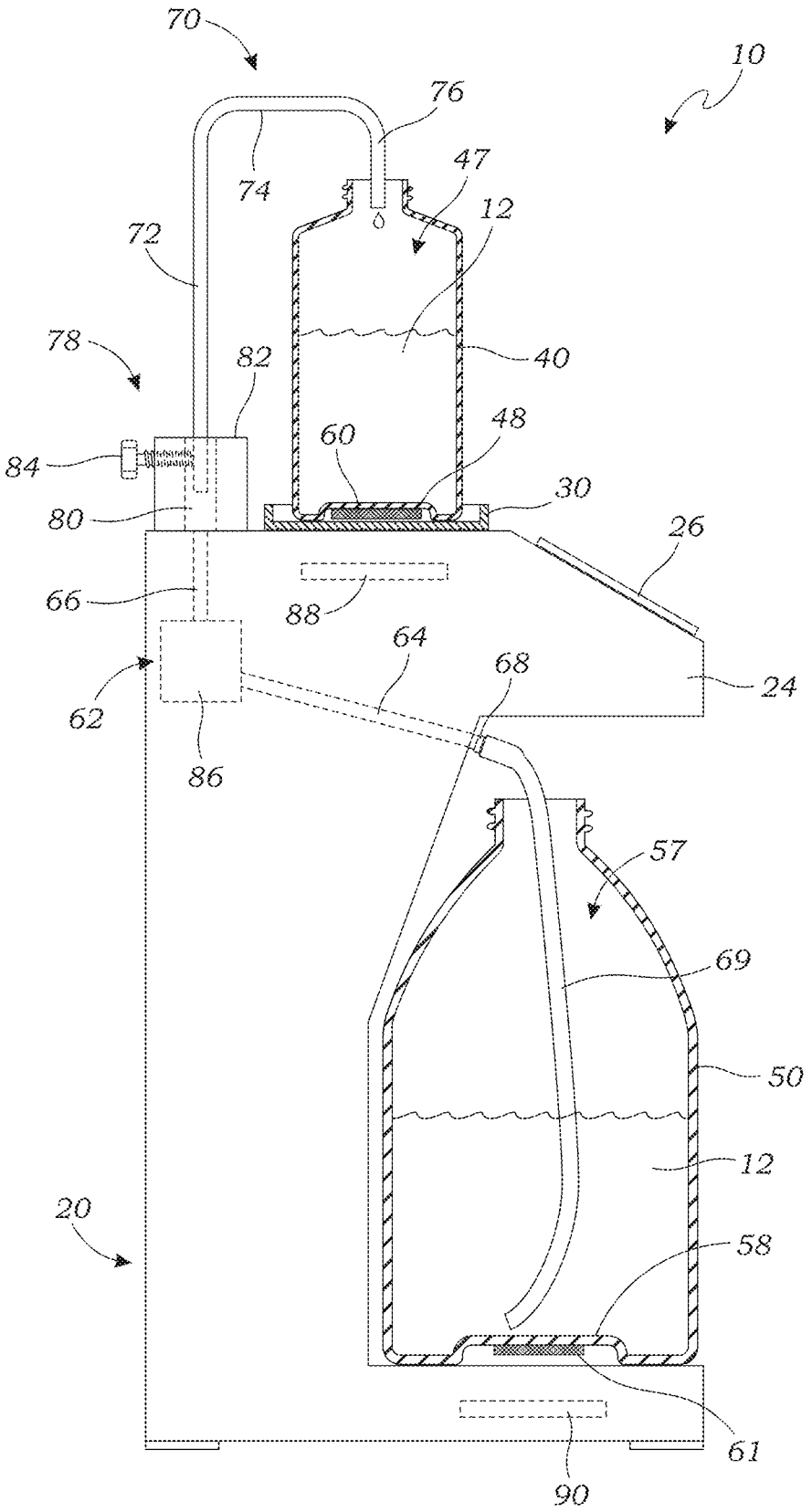
FIG. 3 is a side elevation view thereof.

FIG. 1 is a perspective view of a filling station 10 according to one embodiment of the present invention. FIG. 2 is a front elevation view thereof, and FIG. 3 is a side elevation view thereof. As shown in FIGS. 1-3, the filling station 10 includes a station housing 20 having a top pedestal 22 supported above a bottom pedestal 32 by a support body 36. The top pedestal 22 is configurated to support a smaller container 40, and the bottom pedestal 32 being configurated to support a large bulk container 50. The filling station 10 is adapted to transfer fluid 12 from the large bulk container 50 to the smaller container 40 via a fluid flow conduit system 62, discussed in greater detail below.

The support body 36 may be in the form of a rigid housing that extends upwardly, as shown in in FIGS. 1-3, so that the top pedestal 22 is at a higher elevation than the bottom pedestal 32, and the top pedestal 22 may be at least partially directly above the bottom pedestal, when the support body 36 is resting upright upon a support surface for typical use. The support body 36 may have a height that is greater than the height of the large bulk container 50 so that the large bulk container 50 may easily fit at least partially under the top pedestal 22 during use. While one embodiment of the support body 36 is shown, it may have wide variety of particular shapes, sizes, and configurations, and still remain within the scope of the present invention.

The bottom pedestal 32 may be any size, shape, and/or dimensions suitable for supporting the large bulk container 50, and the support body 36 between the bottom pedestal 32 and the top pedestal 22 may be any height necessary for clearance of the large bulk container 50. In some embodiments, the bottom pedestal 32 may include a plurality of feet 34 for supporting the station housing 20 above a support surface (not shown). Furthermore, the top pedestal 22 includes a scale 30 operably mounted thereupon, the scale 30 having a load cell 94 (shown in FIG. 4) for measuring the weight of the smaller container 40, so that the volume of transferred fluid may be readily measured. The scale 30 also enables the station 10 to determine whether there is a smaller container 40 in position, so that the station 10 does not operate until a container is in place (thereby preventing spills, if the station 10 is actuated accidentally, before the container is properly positioned for filling. In other embodiments, a scale may also be included in the bottom pedestal 32 (not shown).

As illustrated, the top pedestal 22 may include a front projection 24 having an operations panel 26 mounted thereupon for operation of the filling station 10. In this embodiment, the operations panel 26 is in the form of a touch screen which displays a plurality of volume selection options 28 (in this case, 200 ml, 300 ml, 400 ml, and an option to enter a custom amount). While the Figures illustrate one embodiment of the volume selection options 28, a greater or fewer number of options may be provided, or other options may be presented, e.g., a "settings" option (for display, audio, etc.), or any other related option known to those skilled in the art. In alternative embodiments of the present invention, the operations panel 26 may instead be in the form of plurality of physical buttons/switches/etc., and/or be located elsewhere on the station housing 20 (e.g., on the support body 36, bottom pedestal 32, etc.).

In this embodiment, a first switch 35 is located on the support body 36 adjacent the bottom pedestal 32 for powering the filling station 10 on/off, and a second switch SW2 is located on the front projection 24 for actuating operation once one of the options 28 has been selected on the touch screen (discussed further below). These are mentioned in more detail below. However, in alternative constructions, the first switch SW1 and the second switch SW2 may be located elsewhere on the station housing 20, or one or both of the switches may be incorporated into the touch screen. Furthermore, the first switch SW1 and/or the second switch SW2 may be operated by a sensor instead of a button/switch/toggle. All of these different arrangements and configurations should be considered within the scope of the present invention, as claimed.

In this embodiment, the large bulk container 50 and the smaller container 40 each comprise a base 42, 52, and a sidewall 44, 54 that extends upwardly to a neck 45, 55 that defines a top opening 46, 56, all together forming a liquid storage compartment 47, 57 for storing the fluid 12. The base 42, 52 of each container 40, 50 may further include a recess 48, 58 for receiving an RFID tag 60, 61, discussed in greater detail below. In the embodiment of FIG. 1, the containers each have a generally rounded cross-section, but in other embodiments, the containers may have a rectangular cross-section, or any other suitable shape for containing the fluid. The containers may be of any standard construction known in the art adapted to contain soap, lotion, shampoo, etc., although any desired liquids may be dispensed, so the examples listed herein should not be considered limiting.

In this embodiment, the station 10 includes a fluid flow conduit system 62 for transporting the fluid from the larger to the smaller containers. In this embodiment, the fluid flow conduit system 62 extends from a fluid intake tube 64 positioned above the bottom pedestal 32, to a fluid outlet port 66 positioned above the top pedestal 22. In the embodiment of FIGS. 1-3, the fluid intake tube 64 is positioned within the station housing 20 and extends from an inlet port 68 to a pump 86. The inlet port 68 extends out of the support body 36 for engagement with a container tube 69, which then extends downwardly into the liquid storage compartment of the large bulk container 50.

In use, the fluid travels up the container tube 69, into the fluid inlet port 68, through the fluid intake tube 64, and out of the fluid outlet port 66. The fluid inlet port 68 may include a quick connect mechanism (not shown) which enables quick and easy connection and disconnection. However, in other embodiments, the fluid intake tube 64 extends from within the station housing 20 into the large bulk container 50, without the need for additional attachments.

As illustrated in FIG. 3, the fluid outlet port 66 may include a rigid U-shaped dispensing conduit 70 having a first leg 72, a middle curved portion 74, and a second leg 76. However, in other embodiments, the fluid outlet port 66 may be comprised of any suitable structures for transferring fluid into the smaller container 40, e.g., a retaining bracket for a flexible tube, or any other structures devised by those skilled in the art. In some embodiments, the rigid U-shaped dispensing conduit 70 is adjustably mounted on the station housing 20 adjacent the top pedestal 22 via a height adjustment mechanism 78. In this embodiment, the height adjustment mechanism 78 includes a vertical bore 80 through a base block 82 that is mounted adjacent the top pedestal 22, such that the first leg 72 of the rigid U-shaped dispensing conduit 70 slidably engages the vertical bore 80, and a set screw 84 through the base block 82 may be tightened to lock the rigid U-shaped dispensing conduit 70 in position with respect to the base block 82. However, in alternative embodiments, the height adjustment mechanism 78 may be in the form of any known adjustment mechanism, e.g., slide-rails, twist-fasteners, etc. Furthermore, in some embodiments, the height adjustment mechanism 78 is excluded.

In some embodiments, the fluid inlet port 68 may be formed with an inlet check valve (not shown) which prevents liquid product 12 from backing out into large bulk container 50, and also prevents liquid from backing out when the large bulk container 50 is removed from the bottom pedestal 32. Alternative structures may be implemented for preventing backflow of the liquid product 12, e.g., resilient molding inside the fluid inlet port 68 that closes when the container tube 69 is disconnected, or similar structures. Furthermore, a similar mechanism may be included in the fluid outlet port 66, to prevent unwanted drip of liquid product.

As shown in FIG. 3, a pump 86 is mounted in or on the station housing 20 for pumping the liquid from the fluid intake tube 64 to the fluid outlet port 66, for transferring the fluid from the large bulk container 50 to the smaller container 40 via the fluid flow conduit system 62, this process being discussed in greater detail below.

As shown in FIGS. 1-3, each container includes an RFID tag 60, 61 mounted in the recess 48, 58 of the base 42, 52. In some embodiments, each recess may further include a bottom cap (not shown) that covers the RFID tag, to protect the tag from damage. The cap may be mounted via a threaded connection, a frictional engagement, adhesive or thermal welding, or other means known in the art.

In this embodiment, the filling station 10 further comprises a first RFID reader 88 mounted in the top pedestal 22, and a second RFID reader 90 mounted in the bottom pedestal 32, for reading each RFID tag 60 and 61, respectively. In this embodiment, the reader is an induction reader for inductively reading the RFID tag. In alternative versions, the RFID tag may be replaced by a different tag such as a QR code or a barcode, wherein the reader would be adapted to read any tag placed in the recess of the container. The reader 88, 90 may be operably connected with any form of electronics, communications, and other electronics for reporting information from the RFID tag 60, 61. The reader module senses the RFID tag to detect the type of container that has been placed onto the top and/or bottom platforms. If the container does not have an RFID tag, or if the RFID tags on the large bulk container 50 and the smaller container 40 do not match, the reader module may block the filling station 10 from operating. For example, in a case where the large bulk container 50 contains shampoo, and the smaller container 40 is labeled for conditioner, the RFID reader would prevent the flow of fluid from the large bulk container 50 into the smaller container 40.

Figure 4:
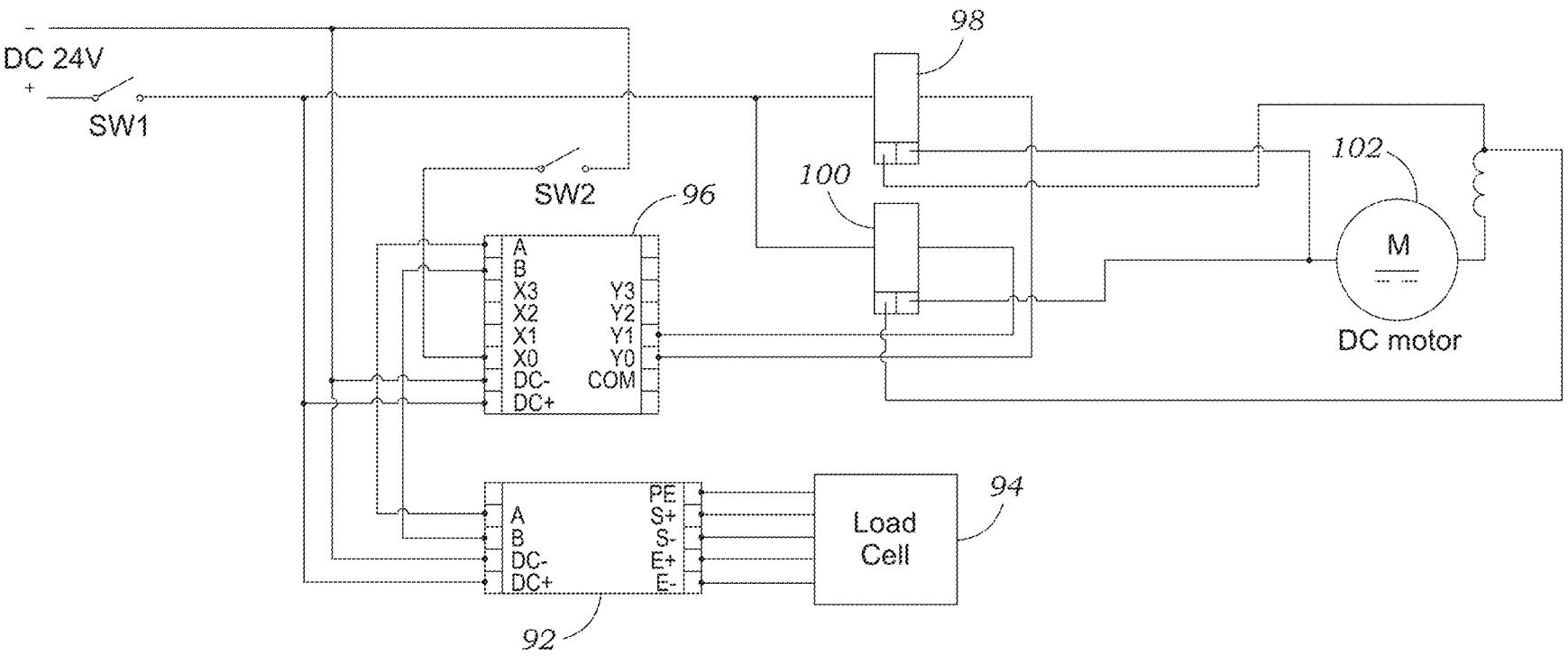
FIG. 4 is a schematic of electronics used in one embodiment of the filling station.

FIG. 4 is a schematic of electronics used in one embodiment of the filling station 10. As shown in FIG. 4, a controller 96 is operably connected with a power source for controlling operation of the station 10. The controller 96 may be any form of computer device, chip, microcontroller, or any other device known in the art controlling this type of station 10. In this embodiment, the power source is operably connected via the first switch SW1 (mentioned above) for turning the station 10 on and off.

The controller 96 is operably connected to a weighing module 92 having the load cell 94 for weighing the smaller container 40. For purposes of this application, the term load cell is broadly defined to include any form of sensor for measuring weight, for the purposes described herein.

The controller 96 is also operatively connected with the second switch SW2 for actuating operation of the station 10. The controller 96 is also operatively connected with a first solenoid 98 and a second solenoid 100, and a motor 102 (of the pump 86, discussed above).

In use, the controller 96 determines, via the weighing module 92 and the load cell 94, whether the smaller container 40 is positioned on top of the scale. If yes, and if the RFID chips of each container indicate a match (i.e., if both indicate they contain/are intended to contain the same fluid, such as shampoo), the controller 96 actuates the motor 102 of the pump 86 for the transfer of fluid. The first solenoid 98 and the second solenoid 100 open the valves to allow the outlet fluid port and/or the inlet fluid port to open for dispensing/receiving fluid.

Operation of the filling station 10 may also be blocked if no smaller container is located on the top pedestal 22, based on the measurement from the scale 30, even if the second switch SW2 is actuated. Further, operation may be ended when the scale detects that a predetermined weight of the liquid has been transferred into the small container. The filling station 10 may also be adapted to track the number of uses, the most frequently-chosen volume selection options 28, etc., and may further use this data to optimize the provided options, alert a user of maintenance needed, etc., which should be considered within the scope of the present invention.

Figure 5:
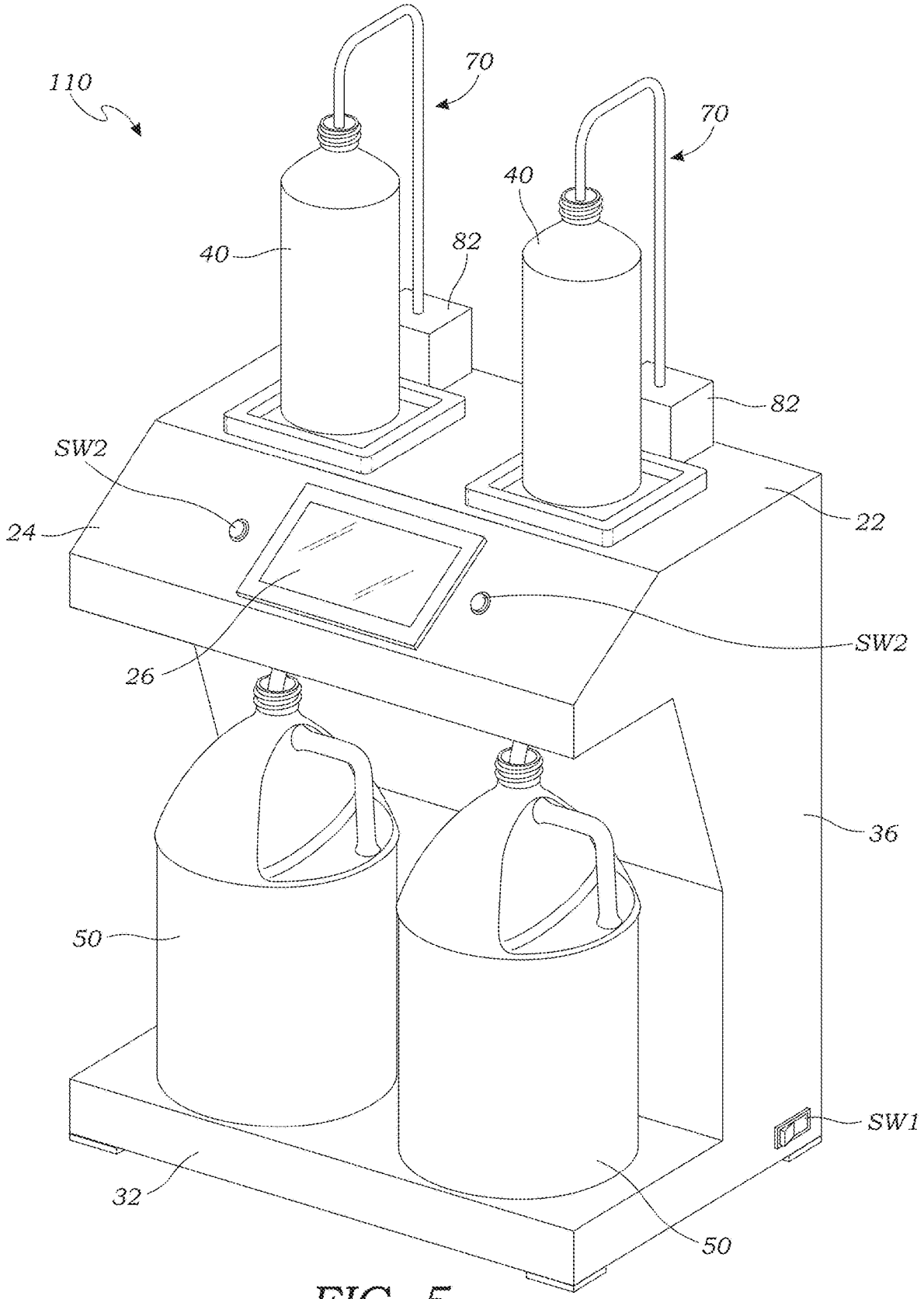
FIG. 5 is a perspective view of a second embodiment of the filling station.

FIG. 5 is a perspective view of a second embodiment of the filling station 110. As shown in FIG. 5, in some embodiments, the filling station 10 may be adapted to support multiple large bulk containers 50 and multiple smaller containers 40 at the same time, so filling can occur simultaneously. While two examples of the station housing 20 are shown and described herein, it should be understood that the station housing 20 may be any size or dimensions necessary to support any size, dimensions, or quantity of containers 40 and 50, as long as the resultant product is within the scope of the claims.

Technical Details of the Filling Station 10:

Voltage: 24V DC (External Power Adapter)
Operating Noise: 35 dB
Filling Volume: 0-1000 ML
Filling Speed: 1.1 L/min Single (FIGS. 1-3):

Power: 100 W
Dimensions: 220×720×300 mm (L×W×H)
Net Weight: 8 KG

Dual (FIG. 5):

Voltage: 24V DC (External Power Adapter)
Power: 150 W
Dimensions: 360×720×300 mm (L×W×H)
Net Weight: 13 KG Obviously, these measurements are intended only for the purpose of example, and should not be interpreted as limiting to the inventive concept. Those skilled in the art may devise units that have different parameters, and also may be adapted to different standards for use in other countries.

In use, a user activates the first switch SW1 to power on the filling station 10. Next, the large bulk container 50 containing fluid is placed on the bottom pedestal 32, wherein the container tube 69 or the fluid intake tube are inserted into the liquid storage compartment. The smaller container 40 is then placed on the scale of the top pedestal 22, and the fluid outlet port 66 is positioned either above the top opening, or inside the neck/liquid storage compartment, which may involve adjusting the height adjustment mechanism 78.

The user then selects from the volume selection options 28 of the touch screen 26 based on the size of the smaller container 40, wherein the RFID readers 88 and 90 check the tags of each container. The user then actuates the second switch SW2. If the RFID tags 60 and 61 match, the controller 96 will actuate the DC motor 102 and pump 86 for transfer of liquid. If the RFID tags do not match, and/or if the weighing module 92 does not detect a container, an alert may sound or appear on the touch screen, or alternatively operation may simply be blocked.

Once fluid flow begins, the weighing module 92 will determine when the correct volume of fluid has been dispensed per the weight selection option, and the controller 96 will stop fluid flow once the weight has been reached.

The title of the present application, and the claims presented, do not limit what may be claimed in the future, based upon and supported by the present application. Furthermore, any features shown in any of the drawings may be combined with any features from any other drawings to form an invention which may be claimed.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A filling station for transferring a liquid from a large bulk container to a smaller container, the filling station comprising:

a station housing having a top pedestal supported above a bottom pedestal by a support body, the top pedestal being configured to support the smaller container, and the bottom pedestal being configured to support the large bulk container;

a scale operably mounted on the top pedestal, the scale having a load cell for measuring the weight of the smaller container;

a fluid flow conduit system that extends from a fluid intake tube positioned above the bottom pedestal, to a fluid outlet port positioned above the top pedestal; and a pump mounted in or on the station housing for pumping the liquid from the fluid intake tube to the fluid outlet port, for transferring the fluid from the large bulk container to the smaller container via the fluid flow conduit system;

wherein the fluid outlet port includes a rigid U-shaped dispensing conduit that includes a first leg, a middle curved portion, and a second leg;

wherein the rigid U-shaped dispensing conduit is adjustably mounted on the station housing adjacent the top pedestal via a height adjustment mechanism; and wherein the height adjustment mechanism includes a vertical bore through a base block that is mounted adjacent the top pedestal, such that the first leg of the rigid U-shaped dispensing conduit slidably engages the vertical bore, and a set screw through the base block may be tightened to lock the rigid U-shaped dispensing conduit in position with respect to the base block.

2. The filling station of claim 1, further comprising a first RFID reader mounted in the top pedestal, and a second RFID reader mounted in the bottom pedestal.

3. The filling station of claim 1, wherein the controller terminates pump operation upon detecting a target fill weight via the scale.

* * * * *